US007270246B2

(12) United States Patent
Butcher et al.

(10) Patent No.: US 7,270,246 B2
(45) Date of Patent: Sep. 18, 2007

(54) NON-CIRCULAR CAN END WITH CORNER-MOUNTED TAB AND TOOLING AND A CONVERSION PRESS FOR PROVIDING SAME

(75) Inventors: Gregory H. Butcher, Lima, OH (US); Kenneth F. Fultz, Sidney, OH (US); Mark R. Mitchell, Sidney, OH (US); David A. Stradling, Troy, OH (US); Greg S. Williams, Wapakoneta, OH (US)

(73) Assignee: Stolle Machinery Company, LLC, Centennial, CO (US)

( * ) Notice: Subject to any disclaimer, the term of this patent is extended or adjusted under 35 U.S.C. 154(b) by 356 days.

(21) Appl. No.: 10/923,279

(22) Filed: Aug. 20, 2004

(65) Prior Publication Data

US 2006/0039780 A1 Feb. 23, 2006

(51) Int. Cl.
*B65D 17/34* (2006.01)

(52) U.S. Cl. ..... 220/273; 220/270; 220/716; 413/67; 413/17

(58) Field of Classification Search ..... 220/269, 220/270, 271, 272, 273, 716, 718
See application file for complete search history.

(56) References Cited

U.S. PATENT DOCUMENTS 3,186,582 A * 6/1965 Henchert ..... 220/272
3,591,037 A * 7/1971 Schrecker et al. ..... 220/273
3,643,382 A * 2/1972 Khoury ..... 220/273
3,653,536 A * 4/1972 Schrecker ..... 220/273
3,715,050 A * 2/1973 Batchelar et al. ..... 220/270
3,720,349 A * 3/1973 Brown ..... 220/273
3,724,709 A * 4/1973 Westphal ..... 220/273
3,735,892 A * 5/1973 Kinkel ..... 220/273
3,762,596 A * 10/1973 Henning et al. ..... 220/273
3,986,632 A * 10/1976 Morrison et al. ..... 220/273
4,096,967 A * 6/1978 Kaminski ..... 220/269
4,576,304 A * 3/1986 Henning ..... 220/269
4,690,297 A * 9/1987 Hoft et al. ..... 220/273
D328,032 S 7/1992 Saunders et al.
5,217,134 A 6/1993 Saunders
5,252,019 A 10/1993 Saunders et al.
5,328,313 A 7/1994 Saunders
5,462,396 A 10/1995 Saunders
5,688,094 A 11/1997 Saunders
D425,419 S 5/2000 Huang
6,401,956 B1 * 6/2002 Heinicke et al. ..... 220/270
2004/0099665 A1 5/2004 McEldowncy et al.

* cited by examiner

*Primary Examiner*—Dmitry Suhol
(74) *Attorney, Agent, or Firm*—David P. Maivald; Eckert Seamans Cherin & Mellott, LLC

(57) ABSTRACT

A non-circular can end for a container having walls which form an opening includes a corner-mounted pull tab opener secured to a severable panel portion by an integral rivet. The corner-mounted opener facilitates easy opening of the can end. A pair of generally parallel bead recesses on either side of the integral rivet stiffen the severable panel portion in order to facilitate bending of the panel aft of the rivet to easily open the can end. The severable panel optionally further includes a mustache-shaped scoreline to reduce the amount of force required to lift the opener. Tooling and a conversion press for converting shells into the non-circular can ends are also disclosed.

14 Claims, 8 Drawing Sheets

2

NON-CIRCULAR CAN END WITH CORNER-MOUNTED TAB AND TOOLING AND A CONVERSION PRESS FOR PROVIDING SAME

FIELD OF THE INVENTION

The present invention relates generally to can ends and, more particularly, to non-circular can ends having a corner-mounted tab. The invention also relates to tooling for producing non-circular can ends having corner-mounted tabs and to conversion presses for converting shells into non-circular can ends having corner-mounted tabs.

BACKGROUND OF THE INVENTION

Non-circular rigid containers house a wide variety of products and materials such as, for example, food products (e.g., without limitation, processed meat products), and are well known in the container and canning industries. Such containers are commonly made of a metallic material such as an aluminum alloy sheet metal, tin plated steel alloy sheet metal, steel alloy sheet metal or some other suitable metal. The containers include walls which form a non-circular opening which must be closed by a can end having a corresponding non-circular shape. It is desirable that the non-circular can end be easy to open and safe (i.e., devoid of sharp edges) when opened.

FIGS. 1 and 2 illustrate a conventional non-circular can end 1 which is generally rectangular. As shown, the can end 1 includes a recessed panel 3 defined by a vertical chuckwall 5 surrounding the periphery of the panel 3. A peripheral scoreline 7, which is contiguous with the base of the chuckwall 5, defines an opening section 9 which is intended to be drawn away or removed from the can end to provide access to its contents. To facilitate rupture of the scoreline 7 and opening of the opening section 9, an opener such as a pull tab 11, is typically mounted on the panel 3. As shown in FIG. 2, the pull tab 11 is typically riveted to the opening section 9 of the panel 3 at the middle of one of the short ends of the can end 1. A separate recessed finger well 13 is included to reach beneath the pull tab 11 in order to initiate rotation thereof As shown, the pull tab 11 (FIG. 2) and rivet 15 attaching the pull tab 11 to the recessed panel 3 are located along a major dimensional centerline axis 17 (in plan view), of the can end 1. See, e.g., U.S. Pat. Nos. 5,217,134; 5,252,019; 5,328,313; 5,462,396; and 5,688,094. For example, for non-cylindrical configurations other than square configurations, such center line axis 17 is disposed along the longer dimension of the can end 1. See, e.g., U.S. Pat. No. 5,217,134 (FIGS. 20, 21 and 27). The centerline axis 17 on which the rivet 15 is located divides the can end 1 into equal halves along its longer dimension and provides for placement of the pull tab 11 on the panel 3 coincident with such centerline axis 17 (FIG. 2).

However, when disposed in such a position, the scoreline 7 extends laterally away from the nose end of the pull tab 11 or generally perpendicular to the nose end of the pull tab 11, thereby requiring an unnecessarily high pulling force on the handle end of the pull tab 11 in order to fracture and continue severing the scoreline 7.

Accordingly, known non-circular can ends of this type frequently further include other features designed to affect the way in which they are opened and removed. For example, some non-circular can ends include projections or recesses around the periphery or transversely disposed on the end panel, in order to, for example, provide a more rigid panel structured to be removed without significant rolling thereof. See e.g., U.S. Pat. No. 5,252,019 (FIGS. 25, 26 and 27); see also, U.S. Patent Des. Pat. Nos. 328,032; and 425,419. Another feature often included on such can ends is a mustache scoreline 19 (FIG. 1) adjacent the attachment rivet 15 on a product side of the can end 1. Such mustache scorelines are designed to facilitate initial rupture of the peripheral scoreline 7 defining the opening section 9 and to provide easy opening of the can end 1 closure without the pull tab 11 being accidentally torn off of the panel 3. See, e.g., U.S. Pat. Nos. 5,217,134; 5,252,019; 5,328,313; 5,462,396; and 5,688,094.

For example, U.S. Pat. No. 5,252,019 entitled "Convenient-Feature Non-Circular End Closure With Interrupted Panel Profiling" describes a "reverse handle-bar mustache" configuration of a back scoreline on the end wall panel. The "reverse handle-bar mustache" score includes leg portions each directed on opposite sides of the rivet to act as a fulcrum for lever action severance of the peripheral scoreline. However, while the mustache score may reduce the initial force required to fracture the scoreline, the disclosed can end and pull tab design nonetheless require rotating the pull tab until it engages the chuckwall and then using the chuckwall as a fulcrum to facilitate continued severance of the scoreline and opening of the can end. Additionally, disposing a mustache score on the product side of the can end requires a post score coating operation to protect the rigid container material that has been scored from oxidation when using a rigid container material that oxidizes.

It is, therefore, desirable to provide a non-circular can end which overcomes the aforementioned disadvantages.

Accordingly, there is room for improvement in non-circular can ends, in tooling used to manufacture non-circular end can ends and in conversion presses for converting shells into non-circular can ends.

SUMMARY OF THE INVENTION

It is an object of the present invention to provide a non-circular can end wherein fracture of the scoreline is initiated at a location of relative stress concentration and wherein said scoreline severance propagates along a naturally occurring stress gradient in the general direction of the pulling force as opposed to laterally away therefrom or perpendicularly thereto.

It is another object of the present invention to provide a corner-mounted tab structured to provide such initial scoreline fracture and severance propagation at the corner of the severable panel to which the tab is attached.

It is another object of the present invention to provide a non-circular end closure which does not require extended rotation of the tab and use of the chuckwall as a fulcrum in order to assist in severing the scoreline.

It is another object of the present invention to provide a number of safety folds to prevent injury potentially caused by the severed scoreline.

It is yet another object of the present invention to provide generally parallel bead recesses on either side of the rivet attaching the pull tab, in order to facilitate bending of the panel aft of the rivet island to easily open the can end.

It is another object of the present invention to provide tooling for manufacturing non-circular can ends having corner-mounted tabs.

It is another object of the present invention to provide a conversion press for converting shells into non-circular can ends having corner-mounted tabs.

Certain objects of the invention are obtained by providing a non-circular can end for a container having walls which form a non-circular opening, the non-circular can end comprising: a recessed panel having a product side facing toward the container and a public side facing away therefrom; a number of safety folds integrally connected to the recessed panel; a non-circular score line adjacent to the safety folds that defines a severable panel portion in the recessed panel, the severable panel portion having a corner with a predetermined radius of curvature; a tab attached to the severable panel portion with a rivet at the corner thereof, the tab including a handle end and a nose end, the nose end structured to sever the scoreline at the corner when the handle end is lifted; a chuckwall having a first end and a second end, the first end of the chuckwall integral with the recessed panel and extending generally vertically therefrom; and a seaming portion integral with the second end of the chuckwall and structured to attach and secure the non-circular can end to the walls of the container with the scoreline located adjacent to the first end of the chuckwall.

The rivet may be an integral rivet which secures the nose end of the tab to the corner of the severable panel portion on the public side of the recessed panel, wherein the severable panel portion further includes first and second generally parallel bead recesses disposed on opposite sides of the integral rivet. The tab may be a pull tab opener including an axis extending through the center of the handle and nose ends thereof and through the corner which forms an angle of about 40° to 50° (forty degrees to fifty degrees) with respect to axes that extend through the scoreline from an edge of the corner of the can end, wherein the first and second generally parallel bead recesses are substantially parallel to the axis of the pull tab opener.

The severable panel portion may further include a rivet island and at least a mustache-shaped scoreline aft of the rivet island and extending generally outwardly, away from the rivet island symmetrically disposed on either side of the rivet with respect to the axis of the pull tab opener.

The severable panel portion may further include one or more raised longitudinal beads disposed in the severable panel portion.

The present invention further includes tooling and a conversion press for making such non-circular can ends.

BRIEF DESCRIPTION OF THE DRAWINGS

A full understanding of the invention can be gained from the following description of the preferred embodiments when read in conjunction with the accompanying drawings in which:

FIG. 6 shows the can end result and tooling for forming a bubble for an integral rivet and at least one of a number of preliminary folds.

FIG. 7 shows the can end result and tooling for further forming a button and a scoreline.

FIG. 8 shows the can end result and tooling for further forming a second button and finishing the safety folds.

FIG. 9 shows the can end result and tooling for forming raised beads in the recessed panel.

DETAILED DESCRIPTION OF PREFERRED EMBODIMENTS

Figure 1:
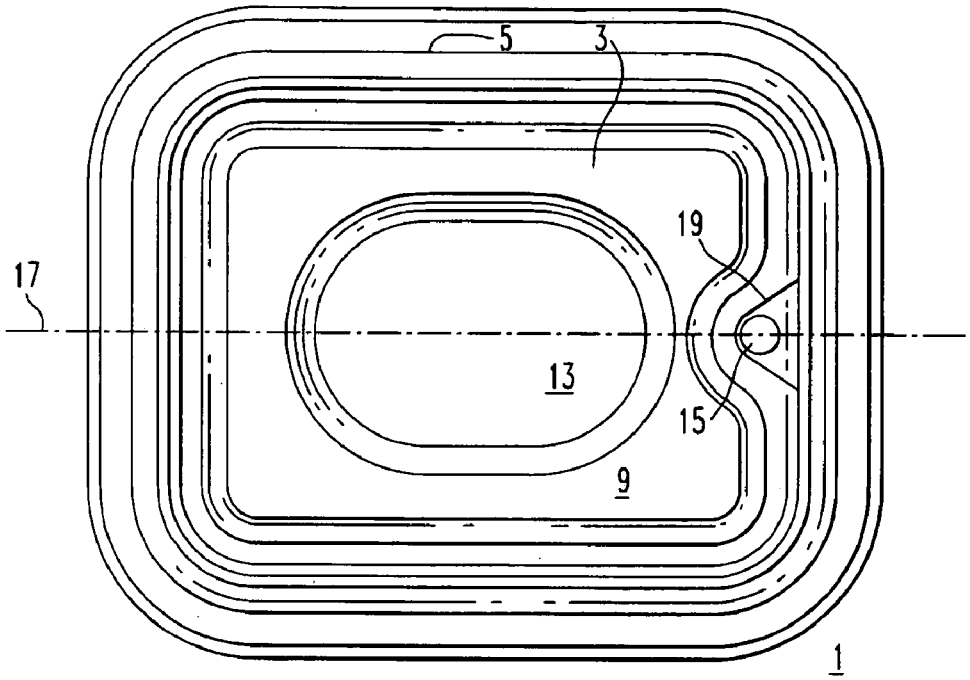
FIG.1 PRIOR ART
FIG. 1 is a bottom plan view of the product side of a non-circular can end with an integral rivet for mounting an opening tab in the middle of one end of the short ends of the can end along an axis extending therethrough.

For purposes of the description hereinafter, the terms "upper", "lower", "vertical", "horizontal", "top", "bottom", "aft", "behind", and derivatives thereof shall relate to the invention, as it is oriented in the drawing figures. However, it is to be understood that the invention may assume various alternative configurations except where expressly specified to the contrary. It is also to be understood that the specific elements illustrated in the drawings and described in the following specification are simply exemplary embodiments of the invention. Therefore, specific dimensions, orientations and other physical characteristics related to the embodiments disclosed herein are not to be considered limiting. As employed herein, the term "number" refers to one or more than one (i.e., a plurality). As employed herein, the statement that two or more parts are "coupled" together shall mean that the parts are joined together either directly or joined through one ore more intermediate parts. As employed herein, the term "aft" shall mean behind or in back of For example, the optional mustache score of the present invention is aft of the rivet island in that it is positioned behind it, on the opposite side of the rivet island from the chuckwall. As employed herein, the term "relative stress concentration" refers to a location on the exemplary can end where stresses (i.e., tensile stress) are likely to be higher or more concentrated in comparison to other locations on the closure. For example, it is well known that stresses are concentrated in areas of abrupt or sharp changes in contour, such as, for example, at a corner, like the corners of the exemplary can end. Similarly, it is well known that "stress gradients" propagate away from such areas of stress concentration. Accordingly, much the same as cracks will propagate or radiate away from a crack in the windshield of a vehicle, by locating the exemplary tab at an area of relative stress concentration—the corner of the non-circular can end—the can end will be easier to open, when compared to the known prior art.

Figure 3:
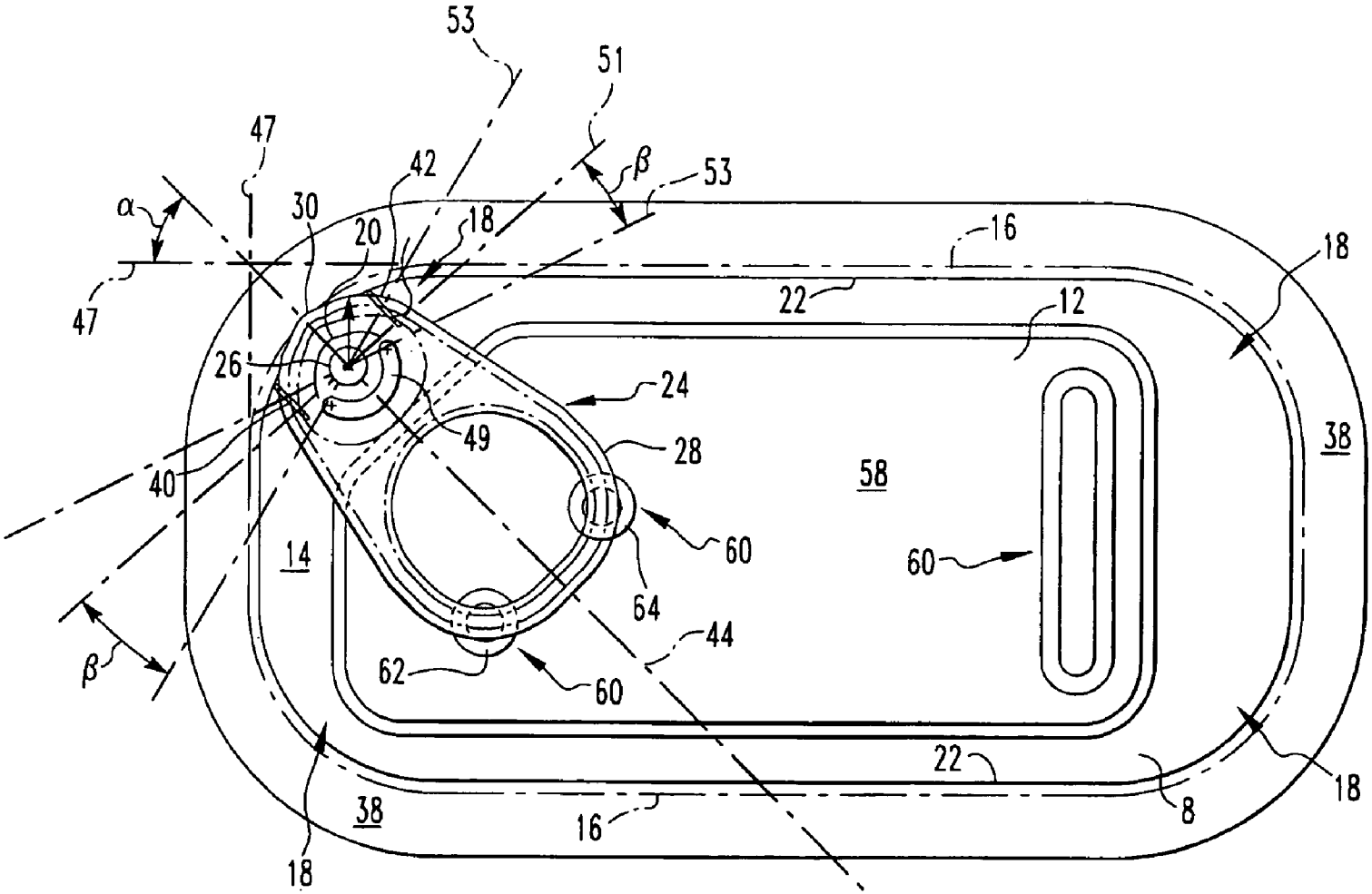
FIG. 3 is a top plan view of the public side of a non-circular can end with a corner-mounted tab in accordance with an embodiment of the invention.
Figure 11:
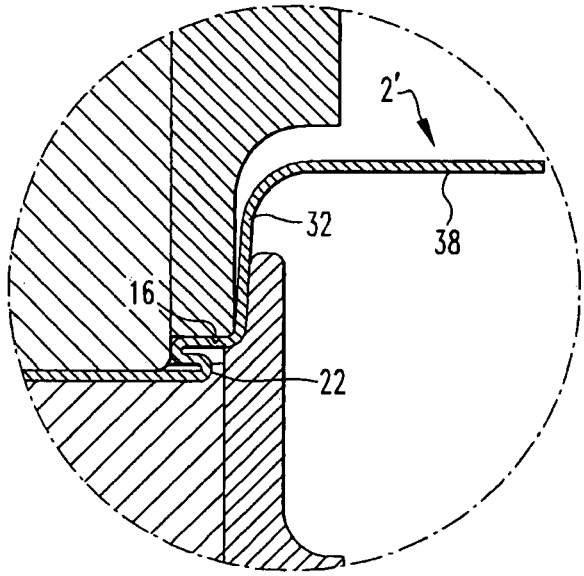
FIG. 11 is an enlarged view of the tooling and can end structure of FIG. 8.
Figure 12:
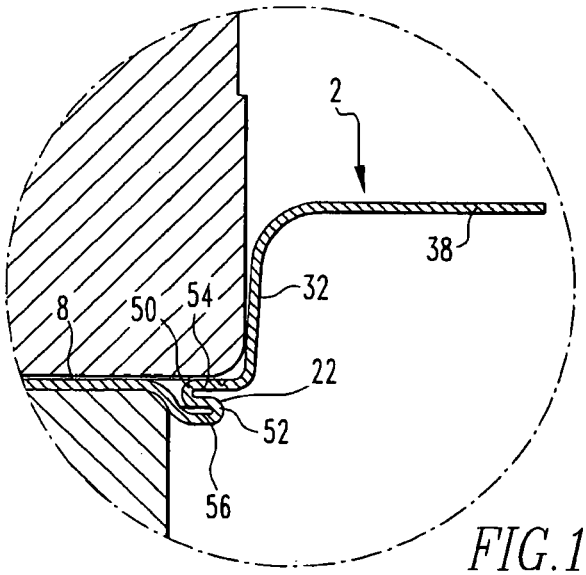
FIG. 12 is an enlarged view of the tooling and can end structure of FIG. 9.

Referring now to FIG. 3, a top plan view of the invention is provided. A non-circular can end 2 is shown for attachment to, for example, a container (not shown) having walls which form a corresponding non-circular opening. The non-circular can end 2 includes a recessed panel 8. The exemplary recessed panel 8 is generally rectangular in shape. The recessed panel 8 has a product side 10 facing toward the container and a public side 12 facing away therefrom. A severable panel portion 14 is defined by a scoreline 16 in the recessed panel 8. The severable panel portion 14 includes a corner 18 with a predetermined radius of curvature 20. It will be appreciated that the corner 18 may have any suitable radius of curvature other than that shown in FIGS. 3 and 4. The exemplary generally rectangular non-circular can end 2 further includes a number of safety folds 22 (FIG. 5) adjacent the scoreline 16 and integral with the severable panel portion 14. The safety folds (e.g., 22) form a protective peripheral edge on the severable panel portion 14 when it is torn along the scoreline 16. The folds of the present invention are best shown in FIG. 5 and FIGS. 11-12. Specifically, as shown in FIG. 12, the exemplary number of safety folds 22 includes two folds comprising first and second bends 50, 52 each of about 180 degrees in order to form an s-shaped cross-section having a top fold 54 and a bottom fold 56. As shown, the exemplary safety folds 22 are unique in that the bottom fold 56 of the s-shaped cross-section is off-set from the recessed panel 8. It will, however, be appreciated that any alternative known or suitable safety fold configuration (not shown) could be employed.

Continuing to refer to FIG. 3, the exemplary non-circular can end 2 further includes a corner-mounted tab 24. The exemplary tab is a pull tab opener 24 coupled by a rivet, such as the exemplary integral rivet 26 shown in FIG. 3, to the severable panel portion 14 at one of the corners 18 thereof. The integral rivet 26 may be manufactured utilizing the integral rivet development technology shown and described in U.S. Pat. Nos. 5,749,257; 5,755,134; and 5,851,685. The contents of U.S. Pat. Nos. 5,749,257; 5,755,134; and 5,851,685 are incorporated by reference into this patent application as if fully set forth herein. The exemplary pull tab opener 24 includes a handle end 28 and a nose end 30. The nose end 30 is structured to sever the scoreline 16 at the corner 18 when the handle end 28 is lifted. The non-circular can end 2 also includes a chuckwall 32 having a first end 34 (FIG. 5) and a second end 36 (FIG. 5). The first end 34 of the chuckwall 32 is integral with the recessed panel 8 and extends generally vertically therefrom. A seaming portion 38 is integral with the second end 36 (FIG. 5) of the chuckwall 32 and is structured to attach and secure the non-circular can end 2 to the walls of the container (not shown). The scoreline 16 is located about 0.0187 inches from the first end 34 of the chuckwall 32. The scoreline 16 could be located anywhere from about 0.0150 inches to about 0.0200 inches from the first end 34 of the chuckwall 32. In alternative embodiments that may use a generally right-angled triangular score knife of the type shown in U.S. Pat. No. 5,462,396 for formation of the scoreline 16, the scoreline 16 could be located anywhere from about 0.001 inches to about 0.0015 inches from the first end 34 of the chuckwall 32 when using the score knife of U.S. Pat. No. 5,462,396.

As previously discussed, the exemplary rivet is an integral rivet 26 securing the nose end 30 of the exemplary pull tab opener 24 at corner 18 on the public side 12 of the recessed panel 8. The exemplary severable panel portion 14 further includes first and second generally parallel bead recesses 40, 42 which are disposed on opposite sides of the exemplary integral rivet 26. The first and second bead recesses 40, 42 preferably protrude from the product side 10 of the recessed panel 8 on the severable portion 14 thereof. However, it will be appreciated that the bead recesses 40, 42, could alternatively protrude from the public side 12. The exemplary first and second bead recesses 40, 42 are spaced apart, one on either side of the integral rivet 26, and extend substantially parallel opposite one another and substantially parallel to the axis 44 of the pull tab opener 24.

Figure 2:
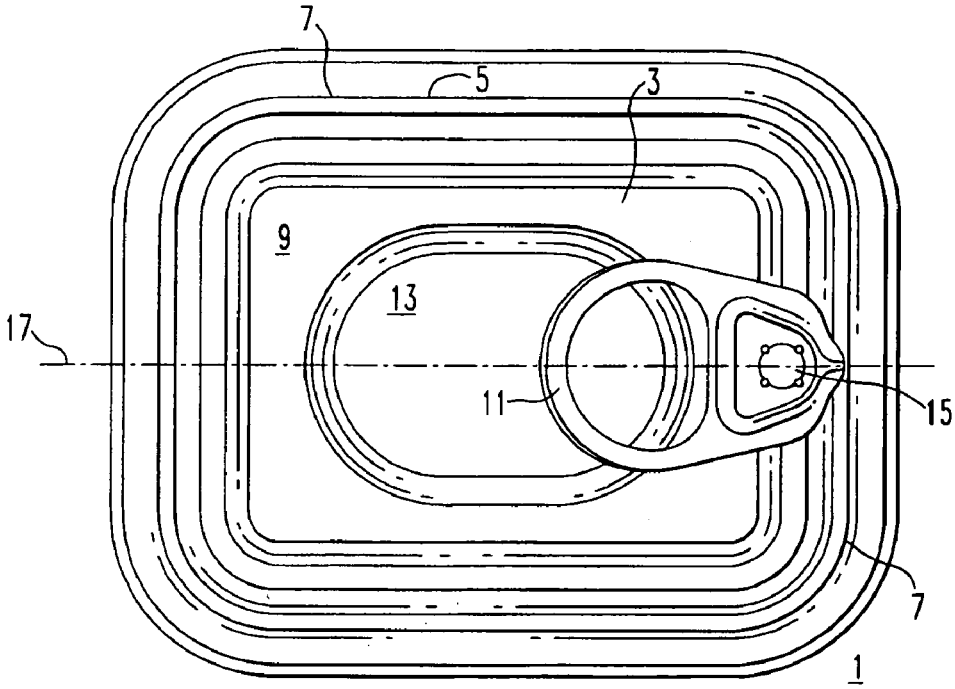
FIG.2 PRIOR ART
FIG. 2 is a top plan view of the public side of the non-circular can end of FIG. 1 with the opening device attached coincident with the axis of the end closure.
Figure 4:
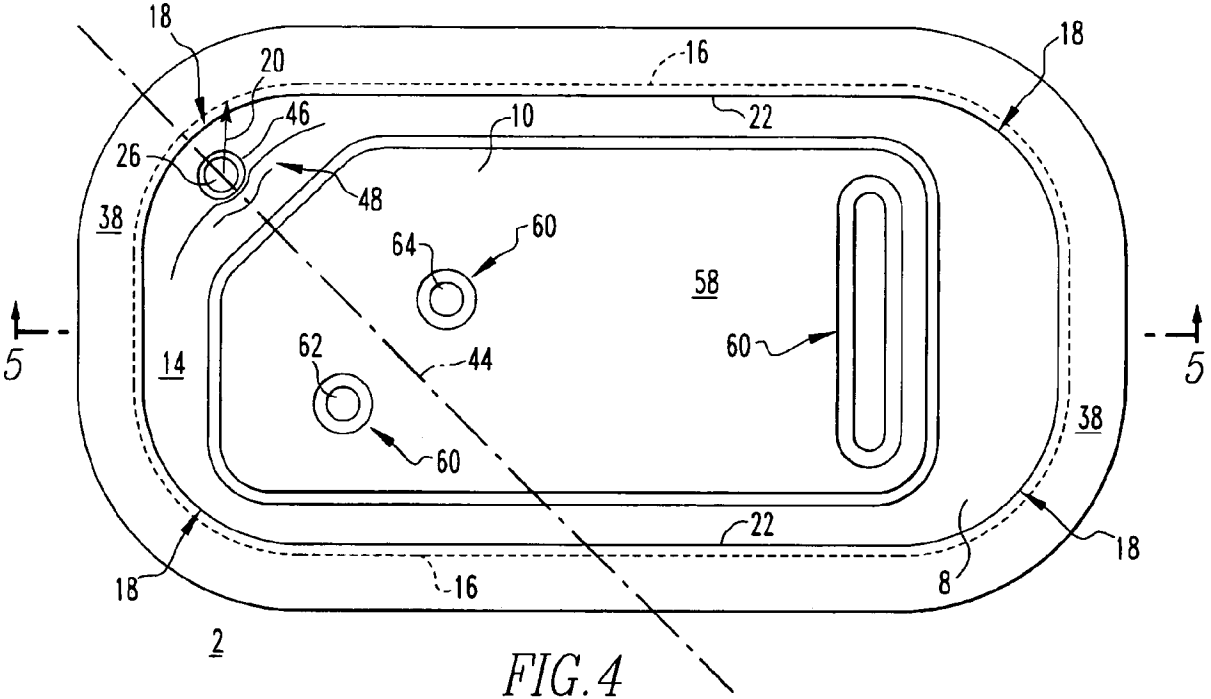
FIG. 4 is a bottom plan view of the product side of a non-circular can end having provisions for a corner-mounted tab in accordance with another embodiment of the invention.
Figure 5:
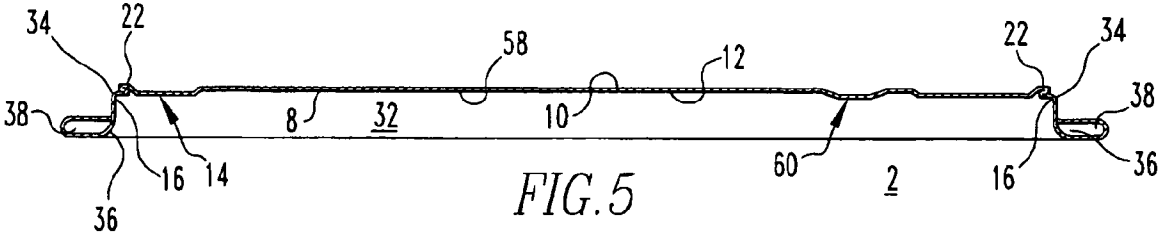
FIG. 5 is a cross-sectional view of the non-circular can end of FIG. 4 taken long line 5-5.

As shown in FIGS. 3 and 4, the axis 44 extends through the center of the handle and nose ends 28, 30 of the exemplary pull tab opener 24 and through the corner 18 which forms an angle $\alpha$ of about 45° (forty-five degrees) with respect to axes 47 that extend through the scoreline 16 from an edge of the corner 18 of the severable panel portion 14 where the opener 24 is attached. As can be appreciated by one of ordinary skill in the art, the angle $\alpha$ may have an angle of about 40° to 50°. The curve in the scoreline 16 at the corner 18 defines a location of relative stress concentration that facilitates opening of the can end since the axes 47 travel along a naturally occurring stress gradient in the general direction of the pulling force applied to the tab 24 as opposed to laterally away from the score line or perpendicularly thereto as is the case with the tabs shown in FIGS. 1-2. As such, less pulling force needs to be applied to the tab 24 of the present invention to open the can end 2 with respect to the prior art can end of FIGS. 1-2. As can be appreciated, it is commercially desirable for end-user consumers to be able to easily access the contents of the can end 2.

The exemplary first and second generally parallel bead recesses 40, 42 function to stiffen the severed metal of the severable panel portion 14. This has the advantageous result of allowing the metal to flex aft of the integral rivet 26 during rotation of the pull tab opener 24.

FIGS. 4 and 5 show a bottom plan view of the product side 10 and a cross-sectional view, respectively, of the exemplary non-circular can end 2. As best shown in FIG. 5, the exemplary integral rivet 26 may optionally include a rivet island 46 which is integral with the severable panel portion 14. As shown in FIG. 4, the severable panel portion 14 may optionally further include at least one product side mustache-shaped scoreline 48 aft of such rivet island 46. The exemplary mustache-shaped scoreline 48 at least partially circumscribes the rivet island 46 and extends generally outwardly away from the rivet island 46 and symmetrically with respect to the axis 44, as shown. Although the exemplary mustache-shaped scoreline 48 is shown as being disposed on the product side 10 of the recessed panel 8 for ease of reviewing the Figures, it will be appreciated by those of ordinary skill in the art, that such scoreline could be included on the public side 12 of the recessed panel 8. It is noted that it is preferable to include the mustache-shaped scoreline 48 on the public side 12 of the recessed panel 8. As shown in the prior art can end of FIGS. 1-2, disposing a mustache score on the product side of the can end requires a post score coating operation to protect the rigid container material that has been scored from oxidation when using a rigid container material that oxidizes. Such an additional step in manufacturing these prior art can ends adds additional costs in manufacturing such can ends and is undesirable from a manufacturing standpoint. It has been found that it is preferable to provide the mustache-shaped scoreline 48 on the public side 12 of the recessed panel 8 since scoreline 16 may require a post score coating operation to protect the rigid container material that has been scored on the public side 12 of the recessed panel 8. As such, the present invention only requires a post operation repair on the public side 12 of the recessed panel 8 whereas the prior art can end of FIGS. 1-2 would require a post operation repair on both sides of the can end.

As noted, the mustache-shaped scoreline 48 is an optional feature of the can end 2 of the present invention since the pull tab opener 24 of the present invention includes a C-shaped slot 49 that is located behind an axis 51 that extends through rivet 26 perpendicular to axis 44. The C-shaped slot 49 has opposite ends defining a bending fulcrum located on the pull tab opener 24 between the handle end portion 28 and the nose end portion 30 behind axis 51. The pull tab opener 24 that has a fulcrum eliminates the need of using a mustache-shaped score line 48 on the can end 2 since the fulcrum that is created is advantageously provided on the pull tab opener 24 not the can end 2. As such, from a manufacturing standpoint, the present invention is more economical than the prior art can end 1 of FIGS. 1-2 that uses a mustache-shaped score line 19 to facilitate opening of the can end 1 with the longitudinally rigid pull tab 11. (i.e., the prior art pull tab 11 does not have a C-shaped slot or lancing along the nose end of the pull tab to make the pull tab 11 somewhat flexible). The ends of the C-shaped slot 49 are located behind axis 51 which is perpendicular to axis 44 and travels through the center of the rivet 26. As is best shown in FIG. 3, axes 53 through the ends of the C-shaped slot 49 and through the center of the rivet 26 form angle β with the axis 51 through the center of the rivet 26. In a preferred embodiment, β is 10.92 degrees but may be other similar angles such as about 1 degree to 20 degrees.

Additionally, the C-shaped slot 49 reduces the overall metal content in the pull tab opener 24 than the prior art pull tab 11 which reduces the overall weight of the can end 2 of the present invention. The reduction in weight is important with regard to reducing the shipping costs associated with distributing the millions of can ends that are used annually around the world.

Furthermore, the number of safety folds 22 in the can end 2 increase the rigidity of the recessed panel 8 that proportionally increases the amount of force that is needed to sever the scoreline 16 with the pull tab opener 24. It is an additional advantage of the present invention that the pull tab opener 24 is of sufficient strength to be able to sever the scoreline 16 of the rigidified recessed panel 8 without pulling the pull tab opener 24 off the rivet 26. Other advantages of the pull tab opener 24 of the present invention is disclosed in U.S. Ser. No. 10/305,455, Filed Nov. 27, 2002, U.S. Pat. Pub. No. 20040099665, Published May 27, 2004, Entitled, "Easy-Opening Can End and a Conversion Press and Tools for Producing the Same". The contents of U.S. Ser. No. 10/305,455 is incorporated by reference into this patent application as if fully set forth herein.

As shown in FIGS. 3-5, it will also be appreciated that the recessed panel 8 of the non-circular can end 2 may optionally further include an integral, generally central second recessed portion 58. The integral, generally central second recessed portion 58 may have a number of projections 60 protruding from the public side 12 thereof. The exemplary second recessed portion 58 includes as such projections 60, first and second handle supporting beads 62, 64 (best shown in FIGS. 3 and 4). The second recessed portion 58 functions, among other things, to provide additional rigidity to the can end 2 and furthermore to facilitate reaching under the pull tab opener 24 in order to initiate lifting thereof.

FIGS. 3 and 4 further illustrate an additional projection 60 protruding from the public side 12 of the second recessed portion 58 and extending transversely along a short end thereof, opposite the end at which the pull tab opener 24 is supported. Such projection 60 may function to further provide additional transverse rigidity of the severable panel portion 14. It will be appreciated that the exemplary transverse projection 60 shown in FIGS. 3 and 4 illustrates only one example of suitable projection. Any number of alternative projections (not shown) in any suitable configuration (not shown) on the second recessed portion 58 or other portions of the recessed panel 8 could alternatively be employed.

Having described the non-circular can end 2 of the invention, FIGS. 6-12 illustrate example tooling 100 that is affixed to a standard conversion press 500, a portion of which is shown in FIGS. 6-9 which is commercially available in the can end industry. As can be appreciated, other tooling could be developed to be affixed to other commercially available conversion presses. The tooling 100 of FIGS. 6-12 is only shown as an example of the tooling 100 that can be used to manufacture the exemplary non-circular can end 2.

Figure 6:
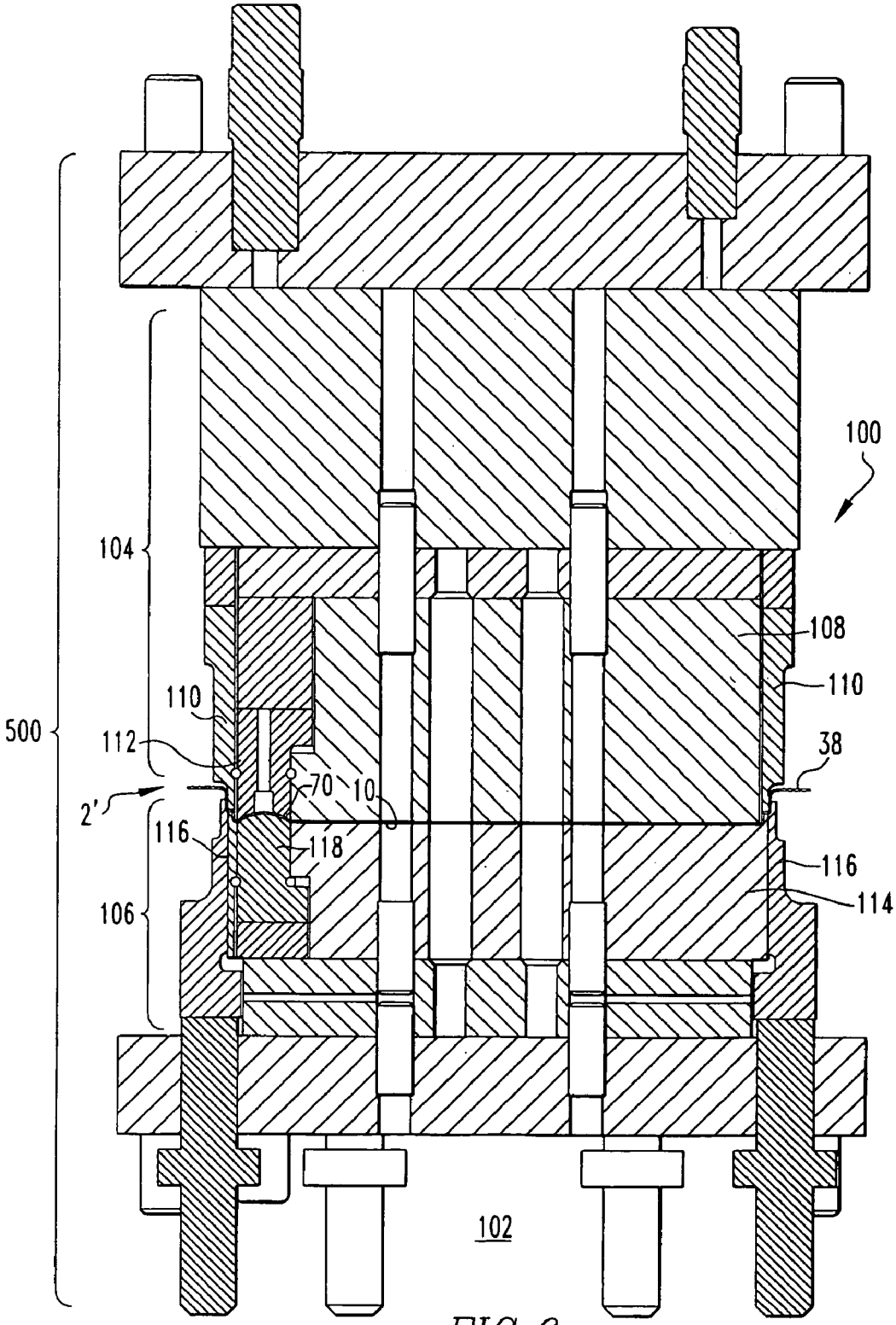
FIGS. 6-9 are cross-sectional views of tooling and can end structure illustrating the steps for making non-circular can ends in accordance with the present invention.

Referring to FIGS. 6-9, respectively, the tooling 100 includes a number of stations, such as the exemplary first, second, third and at least fourth stations 102, 202, 302, 402. FIG. 6 shows the exemplary first station 102 which includes upper tooling 104 and lower tooling 106 wherein one of the upper and lower tooling 104, 106 is adapted to be advanced towards the other of the upper and lower tooling 104, 106, in order to form an initial bubble bend 70 for the formation of the integral rivet 26 (FIGS. 3 and 4) previously discussed, and to form at least one of the number of preliminary folds 22 integral with the recessed panel 8. The exemplary first station upper tooling 104 preferably includes an upper cap 108, an upper ring 110 and a first rivet insert 112. The first station lower tooling 106 is aligned opposite from the first station upper tooling 104 and preferably includes a lower cap 114, a lower ring 116 and a first rivet projection 118, as shown. The lower cap 114 and lower ring 116 are adapted to engage the product side 10 of the recessed panel 8 and to cooperate with the upper cap 108 and upper ring 110, respectively, as shown, in order to form the at least one of the number of preliminary folds 22. The first rivet projection 118 is adapted to cooperate with the first rivet insert 112, as shown, in order to engage and deform a portion of the recessed panel 8 thereby forming the exemplary initial bubble bend 70 for the integral rivet 26.

Figure 7:
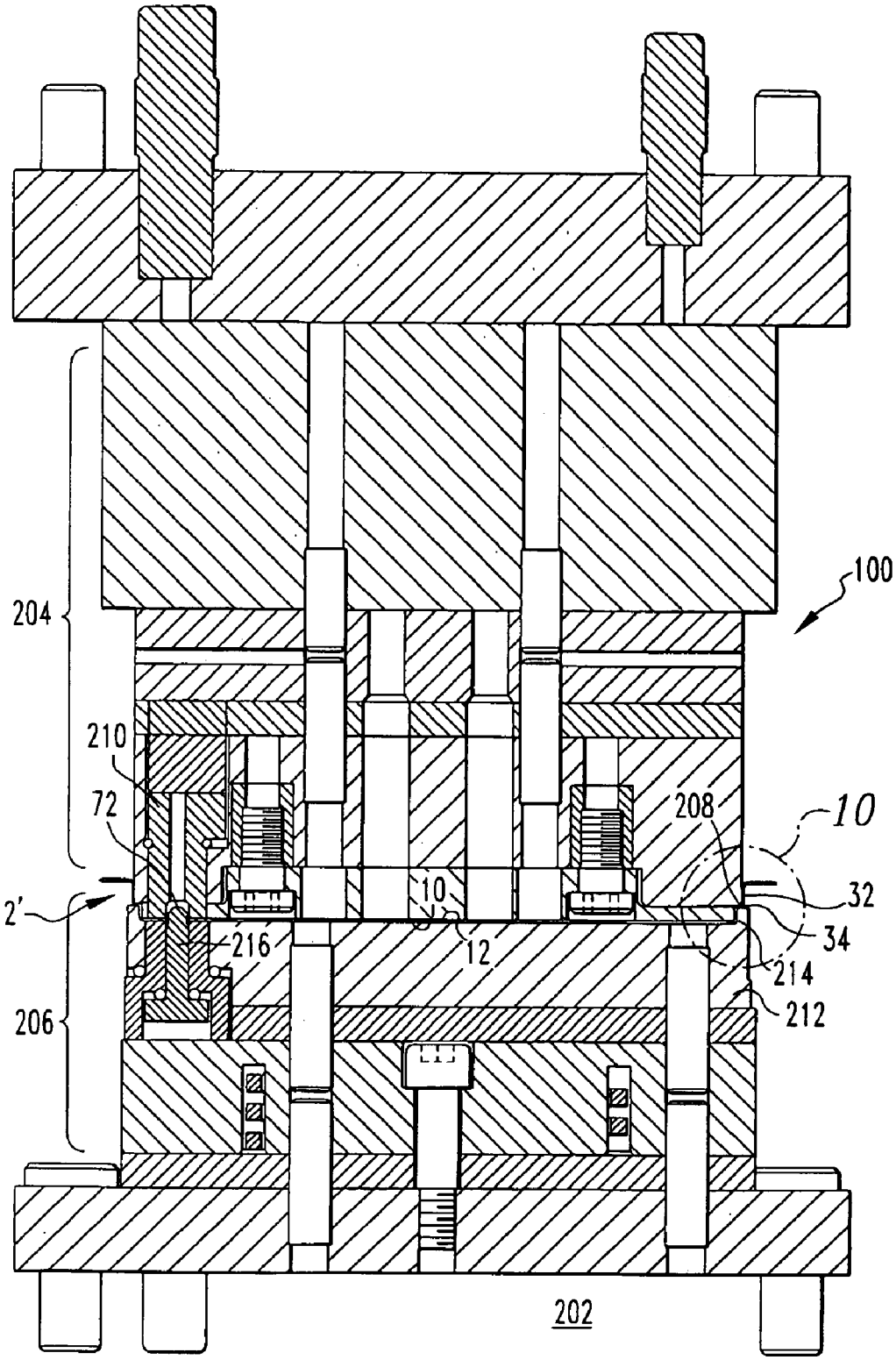

FIG. 7 shows the exemplary second station 202 which also includes upper and lower tooling 204, 206. Like the upper and lower tooling 104, 106 of the first station 102, one of the upper and lower tooling 204, 206 is adapted to be advanced towards the other of the upper and lower tooling 204, 206. The second station 202, as will now be discussed, is designed to form a button bend 72 for the formation of the integral rivet 26 (FIGS. 3-4) and to make the scoreline 16 (best shown in FIG. 10) which defines the severable panel portion 14 (FIGS. 3-5). Specifically, the exemplary second station upper tooling 204 includes a scoring knife 208 and second rivet insert 210. The exemplary scoring knife 208 is structured to score the public side 12 of the recessed panel 8 proximate to, but spaced from, the first end 34 of the chuckwall 32, as shown. Alternatively, the score knife could be of a generally right-angled triangular configuration of the type shown and disclosed in U.S. Pat. No. 5,462,396 for scoring the public side 12 of the recessed panel 8 at a location that is contiguous to the first end 34 of the chuckwall 32. The contents of U.S. Pat. No. 5,462,396 is incorporated by reference into this patent application as if fully set forth herein. The edge of the score knife of U.S. Pat. No. 5,462,396 for formation of the scoreline 16 could be truncated or have a sharp edge. The exemplary second station lower tooling 206 is aligned opposite the second stage upper tooling 204 and includes a lower cap 212 with a rounded supporting surface 214 and a second rivet projection 216. The rounded supporting surface 214 of the lower cap 212 is adapted to support the product side 10 of the recessed panel 8 during formation of the scoreline 16. The second rivet projection 216, like the first rivet projection 118, discussed above in connection with FIG. 6, is adapted to cooperate with the second rivet insert 210, as shown, in order to engage and deform the desired portion of the recessed panel 8 thereby forming the button bend 72 for continued formation of the integral rivet 26.

Figure 8:
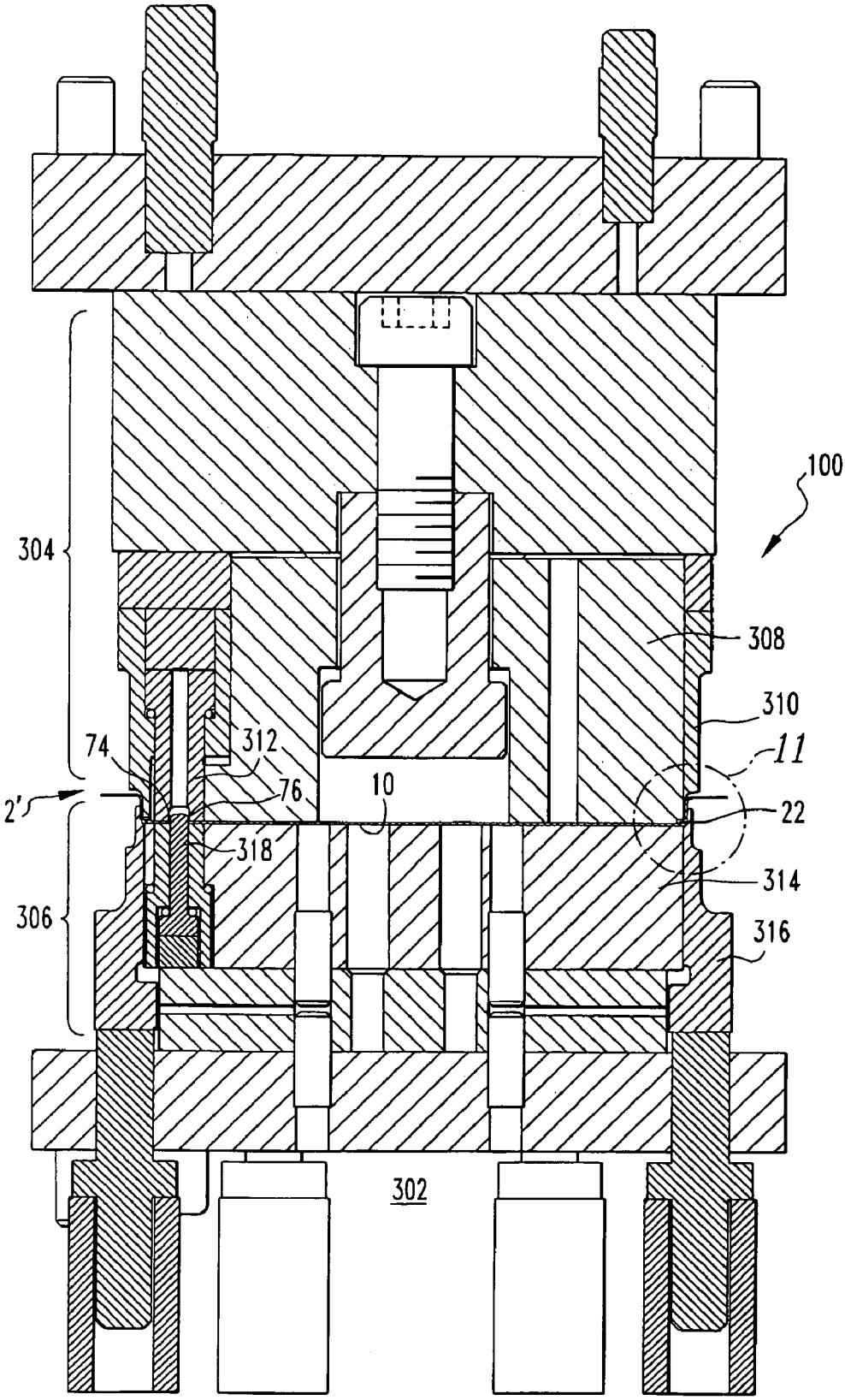

Referring now to FIG. 8, the exemplary third station 302 also includes upper tooling and lower tooling 304, 306 wherein one of the upper and lower tooling 304, 306 is adapted to be advanced towards the other of the upper and lower tooling 304, 306 in order to form a second button bend 74 for continued formation of the integral rivet 26 (FIGS. 3-4) and to complete the number of safety folds 22. The second button bend 74 forms the shank 76 having a diameter sized to receive the pull tab opener 24. The exemplary third station upper tooling 304 preferably includes an upper cap 308, an upper ring 310 and a third rivet insert 312. The third station lower tooling 306 is aligned opposite the first station upper tooling 304, as shown, and preferably includes a lower cap 314, a lower ring 316 and a third rivet projection 318. The upper and lower caps 308, 314 and upper and lower rings 310, 316 cooperate, respectively, as shown, in order to engage the recessed panel 8 and form the remainder of the number of safety folds 22 (as best shown in FIG. 12, the exemplary safety folds 22 include top and bottom folds 54, 56). The third rivet projection 318 engages the product side 10 of the recessed panel 8 and cooperates with the third rivet insert 312 in order to engage and deform the portion of the recessed panel 8 thereby forming a shank portion 76 for the integral rivet 26. It will be appreciated that the shank portion 76 has a predetermined diameter. However, such diameter is not meant to be a limiting aspect of the present invention.

Figure 9:
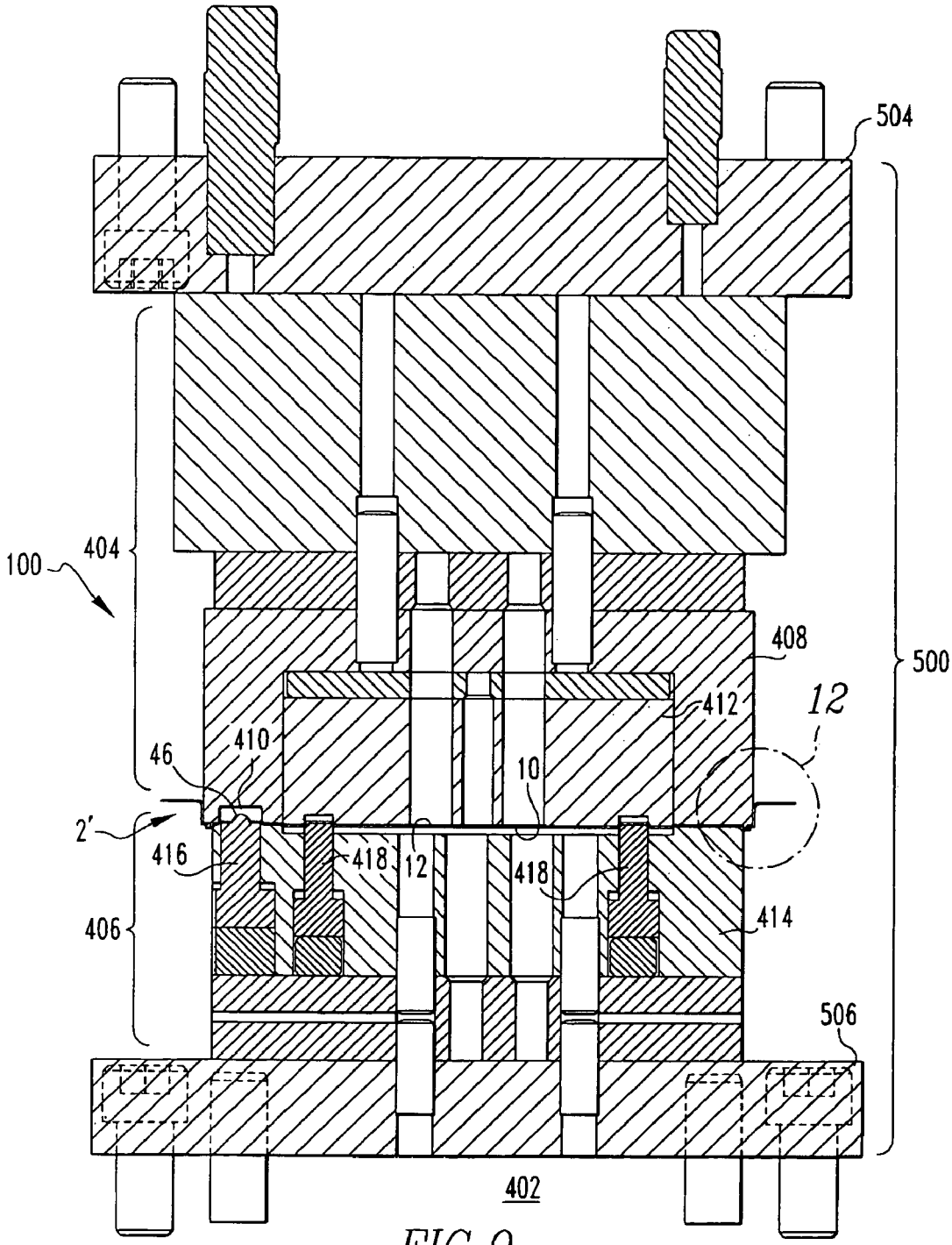

As shown in FIG. 9, at least a fourth station 402 is preferably included in the exemplary tooling 100 of the invention. The exemplary fourth station 402 includes upper tooling and lower tooling 404, 406. As previously discussed, one of the upper and lower tooling 404, 406 is structured to be advanced towards the other one of the upper and lower tooling 404, 406. Alternatively, it will be appreciated that the upper and lower tooling 404, 406 could both move towards each other. This is true for the exemplary first, second and third stations 102, 202, 302 as well. The fourth station 402 is designed to complete the formation of the recessed panel 8, projections 60 and to prepare the integral rivet 26 (FIGS. 3-4) for receiving and securing the exemplary pull tab opening device 24 (FIG. 3) at the corner 18 of the severable panel portion 14 (best shown in FIG. 3). Specifically, the exemplary fourth station upper tooling 404 includes an upper cap 408 having a rivet recess 410, and an upper insert 412 for engaging the public side 12 of the recessed panel 8. The exemplary fourth station lower tooling 406 is aligned opposite the fourth station upper tooling 404, as shown, and includes a lower cap 414, a fourth rivet projection 416 and at least one cap projection 418. The lower cap 14 and the at least one cap projection 418 thereof are adapted to engage the product side 10 of the recessed panel 8 and to cooperate with the upper cap 408, as shown, in order to finish the formation of the recessed panel 8 and projections 60. The exemplary fourth station lower tooling 406 shown in FIG. 9 includes two cap projections 418 for forming the exemplary second recessed portion 58 (FIGS. 3 and 4) in the recessed panel. However, it will be appreciated that any number of cap projections (e.g., 418) other than the exemplary two which are shown, could be employed. Finally, the fourth rivet projection 416 is adapted to fit within the integral rivet 26, as shown, in order to avoid deformation of the integral rivet 26 onto which the exemplary pull tab opener 24 will be staked (best shown in FIG. 3).

The exemplary tooling 100 further includes means to form the exemplary first and second generally parallel bead recesses 40, 42 in the severable panel portion 14 on opposite sides of the integral rivet 26, as previously discussed. The exemplary mechanism for accomplishing this task includes additional projection and insert tooling (not shown) similar to the exemplary cap projections (e.g., 418) and rivet projections and inserts (e.g., 318, 312). The additional projection and insert tools cooperate in order to engage the recessed panel 8 and form the bead recesses 40, 42 (FIG. 3) therein. It will be appreciated that this may be accomplished in one of the exemplary four stations 102, 202, 302, 402, previously discussed in connection with FIGS. 6-9, or alternatively, in another separate station, such as a fifth station (not shown).

Similarly, the exemplary tooling 100 further includes means to form the exemplary optional mustache-shaped scoreline 48 (FIG. 4) on the severable panel portion 14 aft of the exemplary integral rivet 26. This operation is preferably performed by an additional scoring knife (not shown) included as part of the upper or lower tooling (e.g., 104, 106) depending on whether the mustache-shaped scoreline 48 is to be made on the public side 12 or product side 10, respectively, of the severable panel portion 14. Like the formation of the exemplary generally parallel bead recesses 40, 42, it will be appreciated that the exemplary mustache-shaped scoreline 48 may be formed at one of the exemplary four stations 102, 202, 302, 402, or alternatively at a separate station, such as a fifth station (not shown).

Figure 10:
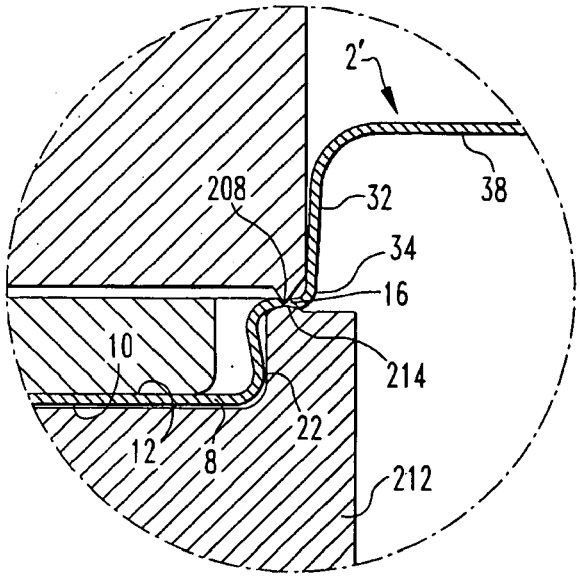
FIG. 10 is an enlarged view of the tooling and can end structure of FIG. 7.

FIGS. 10-12, as referenced hereinbefore, show enlarged detailed views of the partly converted non-circular can ends 2 after having undergone the conversion processes discussed previously in connection with the exemplary second, third and fourth stations 202, 302, 402 of FIGS. 7-9, respectively.

The non-circular can end 2 of the present invention is typically lined in a compound liner apparatus (not shown). The can end 2 may be lined utilizing the fluid dispensing apparatus shown and described in U.S. Pat. Nos. 6,391,387 and 6,547,878. The contents of U.S. Pat. Nos. 6,391,387 and 6,547,878 are incorporated by reference into this patent application as if fully set forth herein. The compound is adhered to the product side 10 along the seaming portion 38 of the can end 2, in order to assist in sealing the can end 2 to the container walls (not shown) during the seaming of the can end 2 to the container body (not shown). The compound is typically cured prior to seaming of the can end 2 to the container body. This step of lining the can end 2 may occur before or after it is conveyed to the standard conversion press (indicated generically as reference 500 in FIG. 9) which is commercially available in the container industry, in order to convert a shell, as previously discussed, into the exemplary non-circular can end 2 having the exemplary safety folds 22 and corner-mounted pull tab 24 with bead recesses 40, 42.

The aforementioned tooling 100 of the exemplary first, second, third and fourth stations 102, 202, 302, 402 may be used in conjunction with the conversion press 500. The conversion press 500 generally includes an upper tooling member 504 and a lower tooling member 506. The exemplary upper and lower tooling members 504, 506 are adapted to receive the upper and lower tooling, respectively, in order to form the exemplary first, second, third and fourth stations 103, 202, 302, 402. It will be appreciated that the upper and lower tooling (e.g., 104, 106; 204, 206; 304, 306-404, 406) may be used with a single conversion press 500 (i.e., interchanged between conversion operations or as separate portions or stations of the same press), or alternatively, with four separate presses, one for each station (e.g., 102, 202, 302, 402).

In the manufacture of the non-circular can end 2 final product, a pre-converted end shell (not shown) is commonly referred to as a shell in the container industry. The shell 2' in FIG. 9 is almost fully converted. In the typical operation of the conversion press 500, the shell 2' is introduced between the upper tooling member 504 and the lower tooling member 506, which are in the open, spaced apart position (not shown in FIG. 9). A press ram (not shown) advances the upper tooling member 504 toward the lower tooling member 506, for example, thereby advancing the upper and lower tooling (e.g., 104, 106; 204, 206; 304, 306; 404, 406) as previously discussed, in order to cooperate and perform any variety of tooling operations such as rivet forming, paneling, scoring, embossing, and final staking. After performing a tooling operation, the press ram retracts until the upper tool member 504 and lower tool member 506 are once again in the open, spaced apart position. The partially converted shell 2' is transported to the next successive tooling station until the desired exemplary non-circular can end 2 is completely formed and discharged from the press 500. Typically, as one shell 2' leaves a given tooling operation, another shell 2' is introduced to the vacated operation, thus continuously repeating the entire can end 2 manufacturing process.

Accordingly, the exemplary conversion press 500 may be adapted to perform each of the manufacturing processes necessary to form the non-circular can end 2 having a corner-mounted pull tab opening device 24, bead recesses 40, 42 and optional mustache-shaped scoreline 48, of the present invention. Therefore, the present invention provides an improved non-circular can end 2 which, by way of its cornered-mounted pull tab opener 24 provides safe, easy opening of the container while requiring less pulling force when compared with the prior art of FIGS. 1-2. The unique bead recesses 40, 42 and optional mustache-shaped scoreline 48 features further improve the exemplary can end design.

While specific embodiments of the invention have been described in detail, it will be appreciated by those skilled in the art that various modifications and alternatives to those details could be developed in light of the overall teachings of the disclosure. Accordingly, the particular arrangements disclosed are meant to be illustrative only and not limiting as to the scope of the invention which is to be given the full breadth of the claims appended and any and all equivalents thereof.

What is claimed is:

1. A non-circular can end for sealing a container having walls which form a non-circular container opening, said non-circular can end comprising:

a recessed panel having a product side facing toward said container and a public side facing away therefrom; a number of safety folds integrally connected to the recessed panel;

a non-circular score line adjacent to the safety folds that defines a severable panel portion in said recessed panel, said severable panel portion having a corner with a predetermined radius of curvature;

a tab attached to said severable panel portion with a rivet at said corner thereof, said tab including a handle end and a nose end, said nose end structured to sever said scoreline at said corner when said handle end is lifted;

a chuckwall having a first end and a second end, said first end of said chuckwall integral with said recessed panel; and a seaming portion integral with the second end of said chuckwall and structured to attach and secure said non-circular can end to the walls of said container with the scoreline located adjacent to the first end of the chuckwall.

2. The non-circular can end of claim 1 wherein said rivet is an integral rivet securing the nose end of said tab to said corner of said severable panel portion on the public side of said recessed panel; and wherein said severable panel portion further includes first and second generally bead recesses disposed on opposite sides of said integral rivet that extend parallel to an axis of the tab that extends through the center of the handle and nose ends of the tab.

3. The non-circular can end of claim 2 wherein said first and second bead recesses protrude from the product side of said recessed panel on the severable panel portion thereof.

4. The non-circular can end of claim 2 wherein said first and second bead recesses protrude from the public side of said recessed panel on the severable panel portion thereof.

5. The non-circular can end of claim 1 wherein said opening device is a pull tab opener, said pull tab opener having an axis extending through the center of the handle and nose ends and through the corner which forms an angle of about 40 degrees to 50 degrees with respect to axes that extend through the scoreline from an edge of the corner of the severable panel portion where the pull tab opener is located.

6. The non-circular can end of claim 5 wherein said rivet is an integral rivet with said severable panel portion; wherein said severable panel portion further includes at least one public side mustache-shaped scoreline aft of said rivet, said at least one mustache-shaped scoreline partially circumscribing said rivet; and wherein said at least one mustache-shaped scoreline extends generally outwardly, away from said rivet symmetric with respect to the axis of said pull tab opener.

7. The non-circular can end of claim 1 wherein said rivet is an integral rivet securing the nose end of said tab at said corner of said severable panel portion on the public side of said recessed panel; and wherein said severable panel portion further includes at least one mustache-shaped scoreline aft of said rivet, said at least one mustache-shaped scoreline partially circumscribing said rivet and extending symmetrically, generally outwardly away from said integral rivet.

8. The non-circular can end of claim 7 wherein said at least one mustache-shaped scoreline includes a public side mustache-shaped scoreline aft of said rivet.

9. The non-circular can end of claim 7 wherein said at least one mustache-shaped scoreline includes a product side mustache-shaped scoreline aft of said rivet.

10. The non-circular can end of claim 1 wherein said recessed panel is generally rectangular in shape; wherein said severable panel portion has a generally rectangular shape; and wherein said scoreline defining said severable panel portion is disposed in the public side of said recessed panel proximate to the first end of said chuckwall.

11. The non-circular can end of claim 1 wherein said number of safety folds includes two safety folds comprising first and second bends of about 180 degrees in order to form a s-shaped cross-section having a top fold and a bottom fold; wherein the bottom fold of said s-shaped cross-section is offset from said recessed panel and wherein said top and bottom folds extend around the entire periphery of said severable panel portion adjacent said scoreline.

12. The non-circular can end of claim 11 wherein said recessed panel further includes an integral, generally central second recessed portion having a number of projections protruding from the public side thereof.

13. The non-circular can end of claim 12 wherein said number of projections protruding from said generally central second recessed portion includes first and second handle supporting beads.

14. The non-circular can end of claim 1 wherein said tab has a C-shaped slot that is located behind a first axis that extends through said rivet perpendicular to a second axis extending through a center of said handle end and said nose end, and wherein a third axis extending through an end of said C-shaped slot and through a center of said rivet forms an angle of about 1 degree to 20 degrees with respect to the first axis.

* * * * *